United States Patent [19]

Isomura et al.

[11] 4,454,847

[45] Jun. 19, 1984

[54] METHOD FOR CONTROLLING THE AIR-FUEL RATIO IN AN INTERNAL COMBUSTION ENGINE

[75] Inventors: Shigenori Isomura, Kariya; Toshio Kondo, Anjo; Katsuhiko Kodama, Kariya; Akio Kobayashi, Kariya; Shuji Sakakibara, Kariya, all of Japan

[73] Assignee: Nippondenso Co., Ltd., Kariya, Japan

[21] Appl. No.: 283,914

[22] Filed: Jul. 16, 1981

[30] Foreign Application Priority Data

Jul. 18, 1980 [JP] Japan ..... 55-98889
Jul. 18, 1980 [JP] Japan ..... 55-98890

[51] Int. Cl.[3] ..... F02B 3/00

[52] U.S. Cl. ..... 123/492; 123/493; 123/480; 123/494; 123/440

[58] Field of Search ..... 123/492, 493, 480, 494

[56] References Cited

U.S. PATENT DOCUMENTS

| | | | |
|---|---|---|---|
| 3,608,532 | 9/1971 | Balluf | 123/493 |
| 3,794,003 | 2/1974 | Reddy | 123/340 |
| 3,982,503 | 9/1976 | Keranon | 123/494 |
| 4,086,884 | 5/1978 | Moon | 123/480 |
| 4,126,107 | 11/1978 | Harada | 123/492 |
| 4,245,605 | 1/1981 | Rice | 123/492 |
| 4,357,923 | 11/1982 | Hideg | 123/492 |

*Primary Examiner*—Ronald B. Cox
*Attorney, Agent, or Firm*—Cushman, Darby & Cushman

[57] ABSTRACT

A method and an apparatus for controlling the air-fuel ratio in an internal combustion engine in which the calculation of the presumed amount of fuel attached to the wall of the intake port of the engine is effected for correcting the amount of the fuel supplied to the engine in order to compensate for the variation of the air-fuel ratio of the air-fuel mixture used in the combustion of the engine.

16 Claims, 17 Drawing Figures

(I)
CAR SPEED
Wo
(II)
PULSE FOR
FUEL
INJECTION
ΔW
Wo
Wn
(III)
DAMPED
FUNCTION
Wn
(IV) VALUE ΔW
ΔW>0
POSITIVE
0
NEGATIVE
ΔW<0
ONE ROTATION
ACCELERATION
DECELERATION
ΣNe

METHOD FOR CONTROLLING THE AIR-FUEL RATIO IN AN INTERNAL COMBUSTION ENGINE

FIELD OF THE INVENTION

The present invention relates to a method for controlling the air-fuel ratio in an internal combustion engine for a motor car.

DESCRIPTION OF THE PRIOR ART

It is well known to correct the amount of fuel supplied to an internal combustion engine of a motor car detecting whether an idle switch is ON or OFF, or whether the rate of change of the air supplying rate or the rate of change of the pressure of the air in the intake manifold is over a predetermined value. Upon such a detection, the amount of the fuel supplied to the engine is increased in accordance with the temperature of the coolant of the engine.

However, in such systems, the detection engine operating condition is not carried out to adequately correct the amount of the fuel supplied. For example, the temperature rise of the wall of the intake port passage constructed in the cylinder head (hereinafter referred to as the intake port) engine is not taken into consideration. As a result, the amount of fuel supplied to the engine is sometimes increased too much, while other times not enough. When the fuel increase is excessive, the exhaust gas becomes less desirable, while the fuel increase is not enough, the torque that is generated is insufficient so that the driving feeling is deteriorated and accordingly it is difficult to realize a desirable drivability of the engine. In addition, when the amount of the fuel supplied to the engine is corrected in relation to the length of time from the start of the engine, the car does not accelerate smoothly.

SUMMARY OF THE INVENTION

It is a main object of the present invention to provide an improved method for controlling the air-fuel ratio in an internal combustion engine in which the deterioration of the exhaust gas composition is prevented and desirable drivability of the engine is ensured even during the warm-up of the engine.

According to the present invention, the amount of fuel supplied to the engine is controlled in accordance with the parameters of the engine. Thus, data relating to engine load and the engine warm-up condition is obtained. On the basis of the engine load condition and the engine warming condition, the presumed amount of fuel clinging to the intake port wall is calculated. Finally, the amount of the fuel supplied to the engine is corrected in accordance with the presumed amount of fuel attached to the wall. As a result, the variation of the air-fuel ratio of the air-fuel mixture used in the combustion of the engine is compensated.

DESCRIPTION OF THE PREFERRED EMBODIMENTS

Figure 1A:
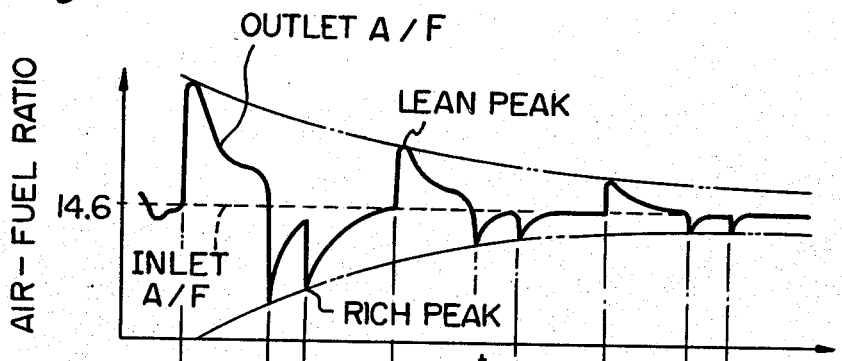
FIGS. 1A, 1B and 1C illustrate the changes of the air-fuel ratio, the changes in temperature of the wall of the intake port and the coolant and the change of car speed, respectively.
Figure 1B:
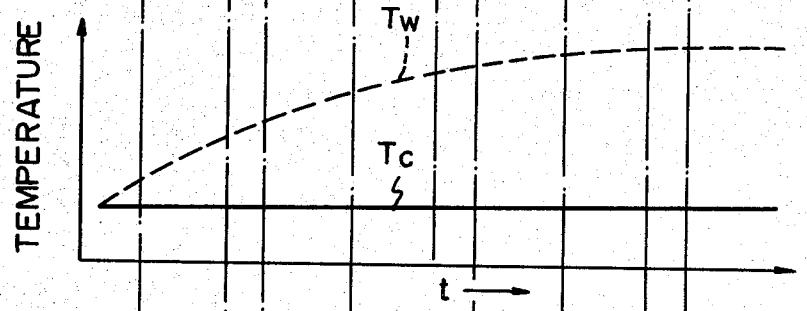
Figure 1C:
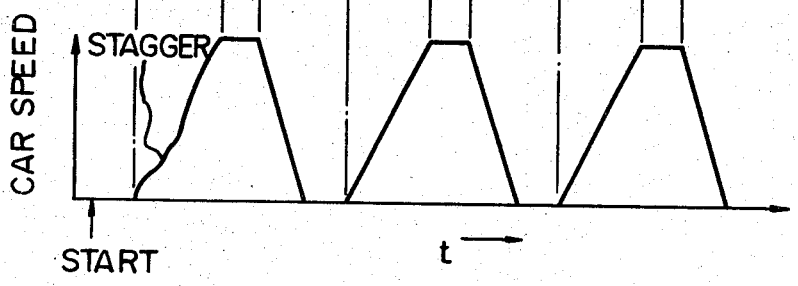

Firstly, the analysis of the results of the experiments conducted by the inventors regarding the change of air-fuel ratio in the process of the operation of an internal combustion engine from the start of the engine will be described with reference to FIGS. 1A, 1B, 1C, 2A and 2B. FIGS. 1A, 1B and 1C illustrate the changes of the air-fuel ratio at the inlet of the engine and at the outlet of the engine (FIG. 1A), the changes in temperature of the wall of the intake port of the engine and the coolant of the engine (FIG. 1B) and the change of the car speed (FIG. 1C) with respect to time (t).

FIGS. 1A, 1B and 1C illustrate the changes in the case where the car has started running immediately after the engine has been re-started with the coolant temperature 40° C., under which temperature the cleaning of the exhaust gas is usually considered to be difficult. In FIG. 1A, it is shown that the inlet air-fuel ratio (INLET A/F) is controlled to maintain the value 14.6 (stoichiometrically ratio, $\lambda=1$) and the outlet air-fuel ratio (OUTLET A/F) varies to a great extent. Here, the inlet air-fuel ratio means the air-fuel ratio of air-fuel mixture controlled by the fuel injection system, and the outlet air-fuel ratio means the presumed air-fuel ratio of the combustion gas, which presumed air-fuel ratio is obtained by detecting a predetermined component in the exhaust gas. The outlet air-fuel ratio becomes large (LEAN) in the acceleration of the engine, and becomes small (RICH) in the deceleration of the engine. The values of the lean peak and the rich peak decrease with the lapse of time from the start of the engine. It can be seen that there exists a close correlation between the characteristic of FIG. 1A and the characteristic of FIG. 1B. In FIG. 1B, the changes of temperature ($T_w$) of the wall of the intake port and the temperature ($T_c$) of the coolant are shown. It can be seen that, by comparing FIG. 1C and FIG. 1A, the greater value of the lean peak and the rich peak appears when the acceleration or the deceleration is carried out more quickly. In FIG. 1C, the crooked portion (STAGGER) of the line indicates the staggering in the increase of the car speed immediately after the start of the car.

Figure 2A:
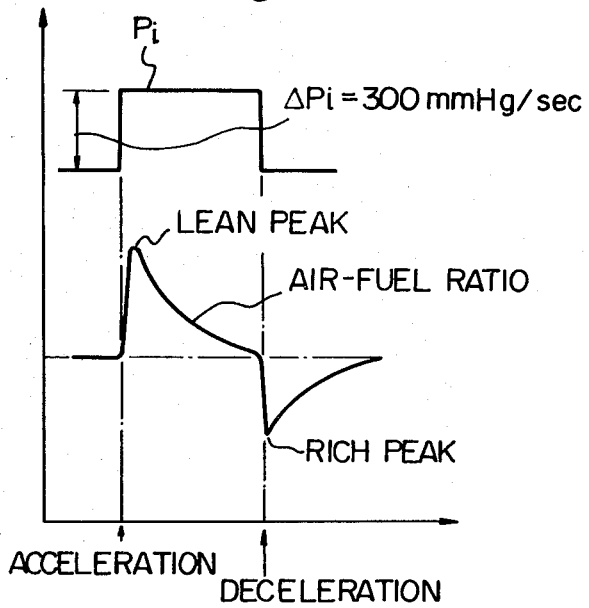
FIGS. 2A and 2B illustrate the relationship between the change of pressure in the intake manifold, the change of the air-fuel ratio and the temperature of the wall of the intake port.
Figure 2B:
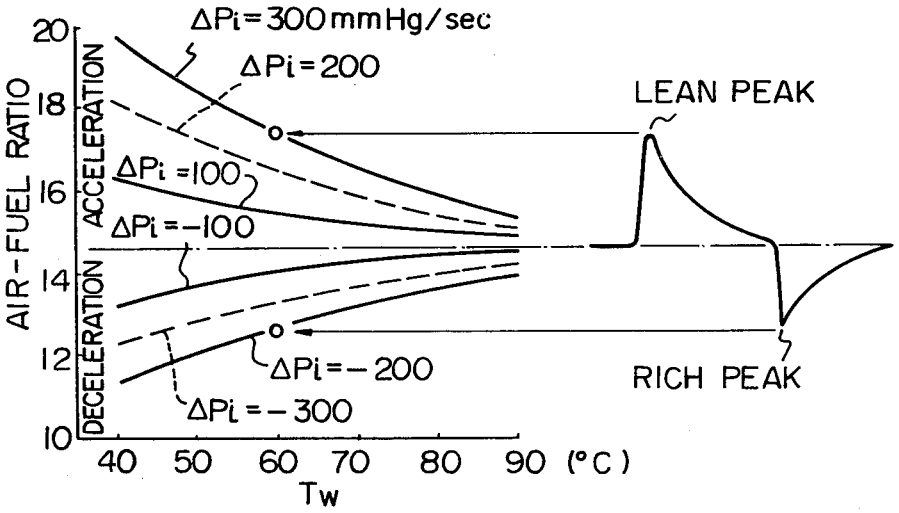

FIG. 2A illustrates the relationship between the change ($\Delta P_i$) of the pressure ($P_i$) in the intake manifold and the peak values of the air-fuel ratio. FIG. 2B illustrates the relationship between the temperaure ($T_w$) of the wall of the intake port and the air-fuel ratio. It can be seen that the lower the temperature ($T_w$) of the wall of the intake port, the greater the values of the lean peak and the rich peak and that the greater the value of the acceleration or the value of the deceleration, the greater the value of the lean peak or the rich peak.

The reason for the characteristic illustrated in FIGS. 2A and 2B is supposed to be that the transmission of the fuel into the combustion chamber of the cylinder is delayed because a portion of the fuel injected from the fuel injection value attaches itself to the wall of the intake port. During acceleration, the amount of the fuel supplied to the cylinder is deficient by the amount of the fuel attached to the wall and accordingly the effective air-fuel ratio becomes lean, while during deceleration, the amount of the fuel supplied to the cylinder is excessive due to the additional supply of the fuel as the result of evaporation of the fuel attached to the wall and accordingly the effective air-fuel ratio becomes rich.

Figure 3:
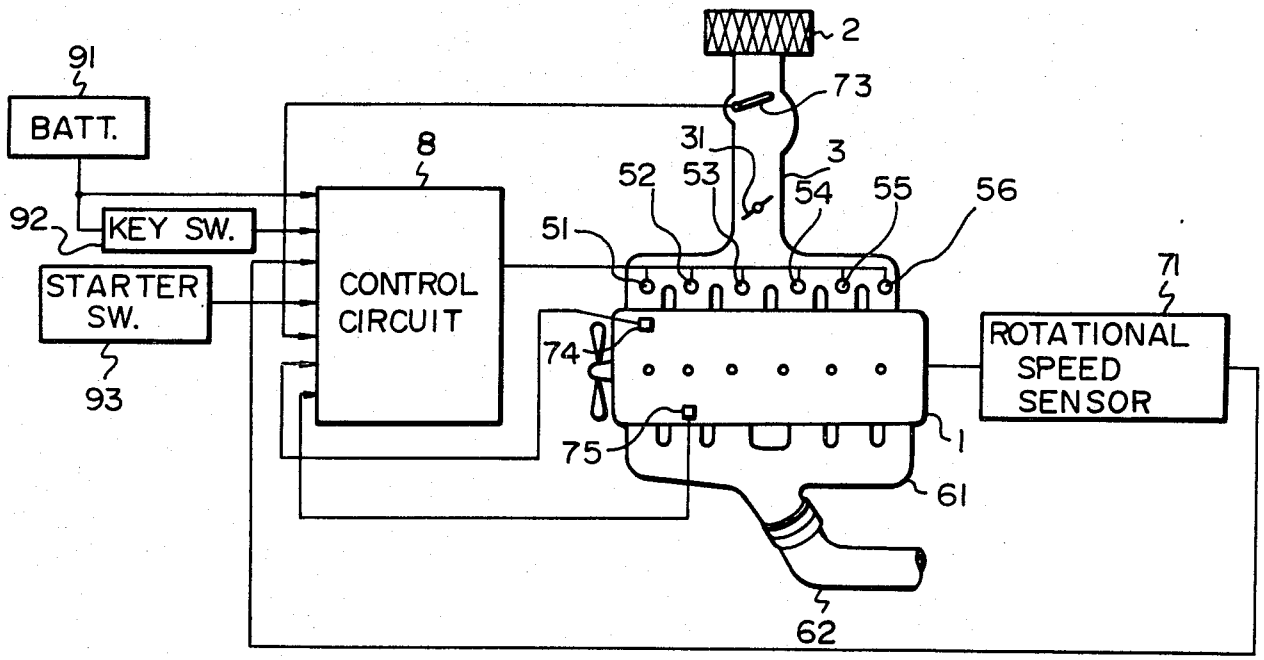
FIG. 3 illustrates an apparatus for controlling the air-fuel ratio as an embodiment of the present invention.
Figure 4:
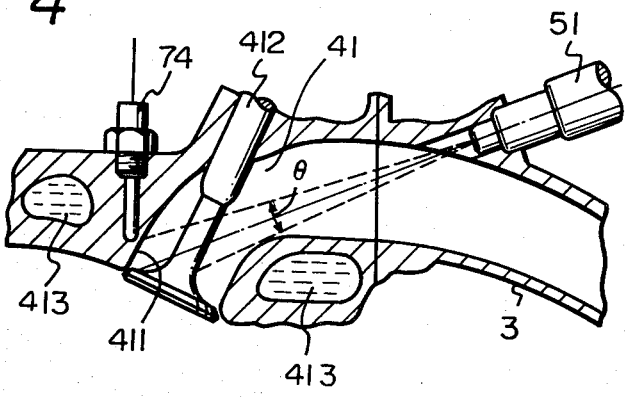
FIG. 4 illustrates the details of the structure of the intake port portion of the apparatus of FIG. 3.
Figure 5:
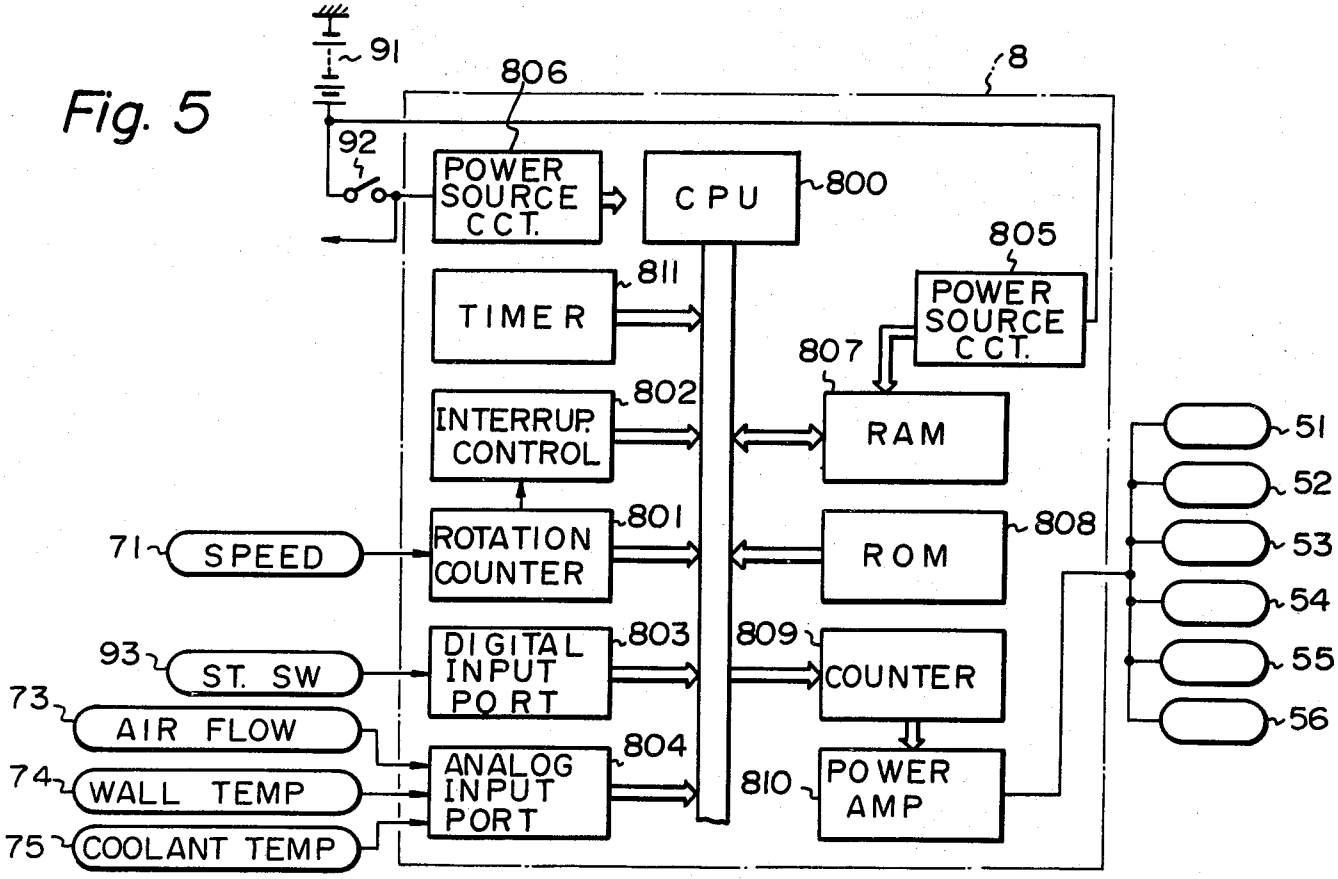
FIG. 5 illustrates the structure of the control circuit of the apparatus of FIG. 3.

An apparatus for controlling the air-fuel ratio in accordance with an embodiment of the present invention is illustrated in FIGS. 3, 4 and 5. A cylinder of the internal combustion engine 1 of a four cycle spark ignition type for a motor car are supplied with air for combustion through an air cleaner 2, an intake pipe 3, a throttle valve 31. The fuel is supplied from the fuel reservoir through each of fuel injection valves 51, 52, 53, 54, 55 and 56 to each of the cylinders of the engine. After combustion in the cylinders, the exhaust gas is discharged through an exhaust manifold 61 and an exhaust pipe 62.

An air flow sensor 73 of a potentiometer type for detecting the air flow rate and producing the analog signal corresponding to the detected rate of air flow is provided in the intake pipe 3. A wall temperature sensor 74 such as a thermistor for detecting the temperature of the wall of the intake port of the cylinder head is provided. A coolant temperature sensor 75 such as a thermistor for detecting the temperature of the coolant of the engine may be provided. A rotational speed sensor 71 for detecting the rotational speed of the crank shaft of the engine and producing a pulse signal having a frequency corresponding to the detected rotational speed is provided. An ignition coil may be used for such rotational speed sensor in which the ignition pulse signal produced from the primary terminal of the ignition coil is used for the rotational speed signal. A control circuit 8 receives signals from the rotational speed sensor 71, the air flow sensor 73, the wall temperature sensor 74 and the coolant temperature sensor 75, calculates the amount of the fuel injection from the received signals and produces the control signal for electromagnetic fuel injection valves 51 through 56 to control the amount of the fuel injection.

The details of the structure of the intake port 41, the intake pipe 3 with the fuel injection valve 51, an intake valve 412, the coolant 413 ad the wall temperature sensor 74 are illustrated in FIG. 4. The fuel injected from the fuel injection valve 51 is diffused at the injection angle $\theta$ toward the end 411 of the port 41. A portion of the diffused fuel is atomized, while considerable portion of the diffused fuel attaches itself to the surface of the intake valve 412 and the wall of the port 41. The wall temperature sensor 74 is located adjacent to the wall 411 of the port 41.

The structure of the control circuit 8 is illustrated in FIG. 5. The control circuit 8 comprises a central processing unit (CPU) 800, a counter 801 receiving a signal from the rotational speed sensor 71, an interruption controlling portion 802 receiving a signal which is synchronized with rotations of the engine from the counter 801 and sending the interruption signal to the CPU 800 through a common bus 812 upon receipt of the signal from the counter 801, and a digital input port 803 receiving a signal from a starter switch 93. The starter switch 93 may be composed of starter contacts in a key switch 92.

The control circuit 8 also comprises an analog input port 804 which consists of an analog multiplexer and an analog to digital converter, converts analog signals from the air flow sensor 73, the wall temperature sensor 74 and the coolant temperature sensor 75 to the digital signals and causes the CPU 800 to read-in the converted data. The output signals of the counter 801, the portion 802, the port 803 and the port 804 are transmitted to the CPU 800 through the common bus 812. A power source circuit 805 supplies power to a random access memory (RAM) 807. The power source circuit 805 is connected directly to a battery 91, so that the RAM 807 is supplied always with power from the battery 91, regardless of the key switch 92. A power source circuit 806 which is connected to the battery via the key switch 92 supplies power to portions of the control circuit 8 except for the RAM 807. The RAM 807 is a non-volatile memory to which power is always supplied from the battery 91 through the power source circuit 805, and the content of the RAM 807 does not disappear when the engine is stopped due to the switching off of the key switch 92. The memory 808 is a read only memory (ROM) in which information regarding the program, various constants, the maps shown in FIGS. 10 and 11 which will be explained later, and the like are stored. A counter 809, for controlling the time for the fuel injection and including registers, consists of the counter of the countdown type. The counter 809 converts a digital signal representing the valve open time of the electromagnetic fuel injection valves 51 through 56, i.e. the amount of the fuel injection, into a pulse signal determining the actual valve open time of the electromagnetic fuel injection valves 51 through 56. The power amplifier 810 produces the signal for driving the electromagnetic fuel injection valves 51 through 56. A timer circuit 811 measures the elapsed time, and the measured elapsed time is transmitted to the CPU 800.

The counter 801 for counting the number of rotations of the engine using the rotational speed sensor 71 supplies an interruption instruction signal to the interruption control circuit 802 when the counting of the counter 801 is terminated. Receiving the interruption instruction signal, the interruption control circuit 802 produces an interruption signal which causes the interruption process routine to start, in which process of the calculation of the amount of fuel injection is carried out.

Figure 6:
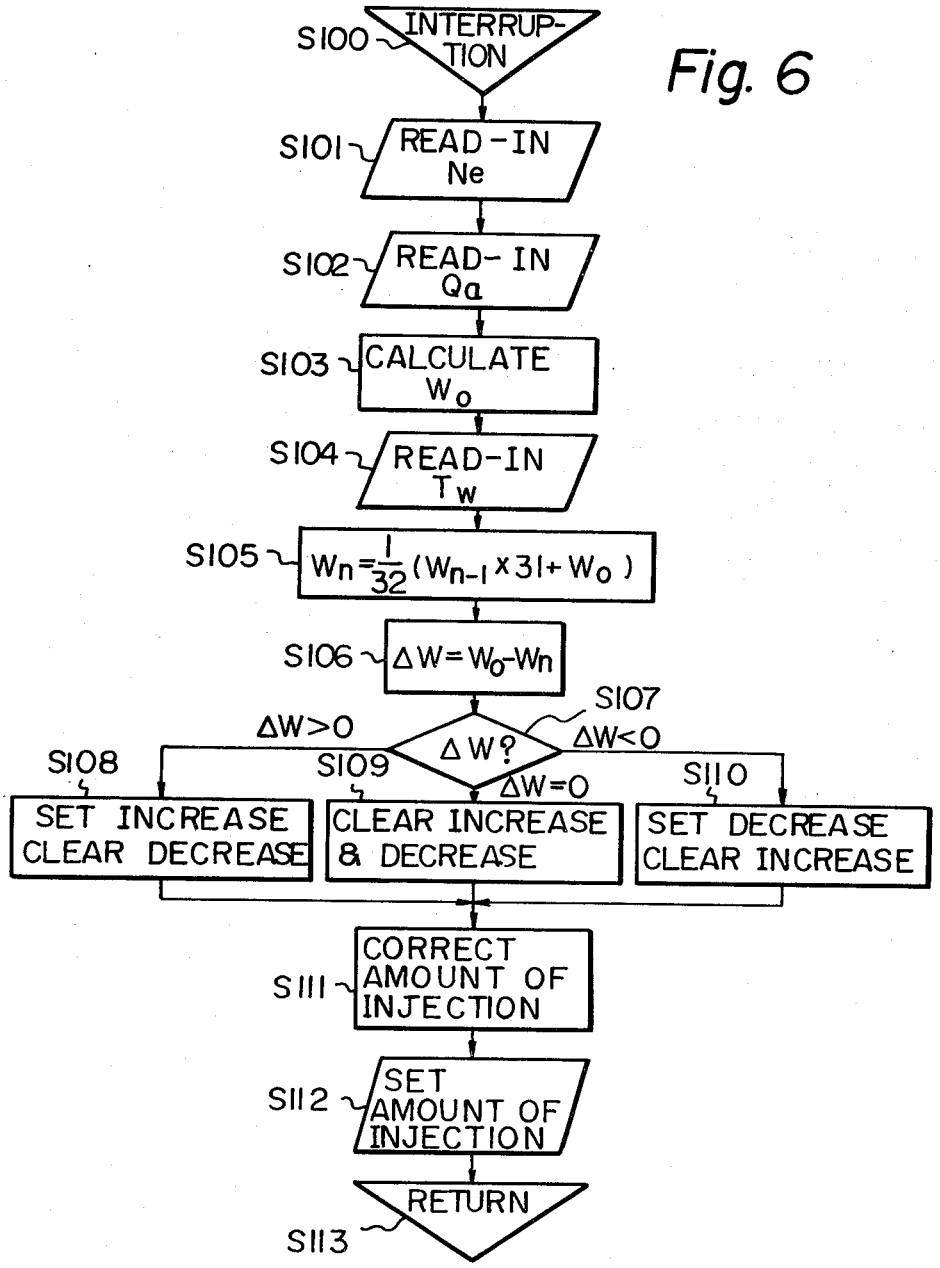
FIG. 6 illustrates a flow chart which is an example of the operation of the central processor unit in the circuit of FIG. 5.

An example of the operation of the CPU 800 in the control circuit 8 of FIG. 5 is illustrated in the flow chart of FIG. 6. Due to the interruption signal from the interruption control circuit 802, the number or speed Ne of rotation of the engine is read-in from the counter 801 in the step S101. The air flow rate $Q_a$ is read-in from the analog input port 804 in the step S102. The base amount of the fuel injection, i.e. the base pulse width $W_o$ for the electromagnetic fuel injection, is calculated from the engine speed Ne and the air flow rate $Q_a$ in the step S103 using equation (1) below.

$$W_o = f \cdot Q_a / N_e \quad (1)$$

where "f" is a constant.

The temperature $T_w$ of the wall 411 of the intake port is read-in from the analog input port 804 in the step S104. The detection of the load condition of the engine is carried out in steps S105 and S106 using equation (2) of the damped function and equation (3), below.

$$W_n = 1/32(W_{n-1} \times 31 + W_o) \quad (2)$$

$$\Delta W = W_o - W_n \quad (3)$$

Equation (2) represents the process of damping the change of the width of the pulse for the fuel injection. $W_n$ is the value of the damped function for the present rotation period of the engine, while $W_{n-1}$ is the value of the damped function for the preceding rotational period of the engine.

The determination whether $\Delta W$ is negative, zero or positive is executed in step S107.

When $\Delta W < 0$, the signal for increasing the amount of the fuel injection is cleared and the signal for decreasing the amount of fuel injection is produced, and the value D for correcting the decrease of the fuel injection is calculated in accordance with the value $\Delta W$ and the temperature $T_w$ using equation (4) below, in step S108.

$$D = \beta \times d \quad (4)$$

where $\beta$ is the factor of the decrease of the fuel injection, and d is the base amount of the decrease of the fuel injection.

When $\Delta W = 0$, both the signals for increasing and decreasing the amount of fuel injection are cleared and the values D and E for correcting the decrease and the increase of the fuel injection are rendered zero, in step S109.

When $\Delta W > 0$, the signal for decreasing the amount of the fuel injection is cleared and the signal for increasing the amount of fuel injection is produced, and the value E for correcting the increase of the fuel injection is calculated in accordance with the value $\Delta W$ and the temperature $T_w$ using equation (5) below, in step S110.

$$E = \alpha \times e$$

Where $\alpha$ is the factor for the increase of the fuel injection, and e is the base amount of the increase of the fuel injection.

The correction of the value $W_o$ of the width of the base fuel injection pulse is effected and the working width of the fuel injection pulse is obtained in step S111. The obtained working width of the fuel injection pulse is fixed in the counter 809 in step S112. Thus the procedure of the routine of FIG. 6 is completed.

The basic characteristics of the operation of the apparatus of FIGS. 3, 4 and 5 will now be described with reference to FIGS. 8, 9, 10 and 11.

Figure 8:
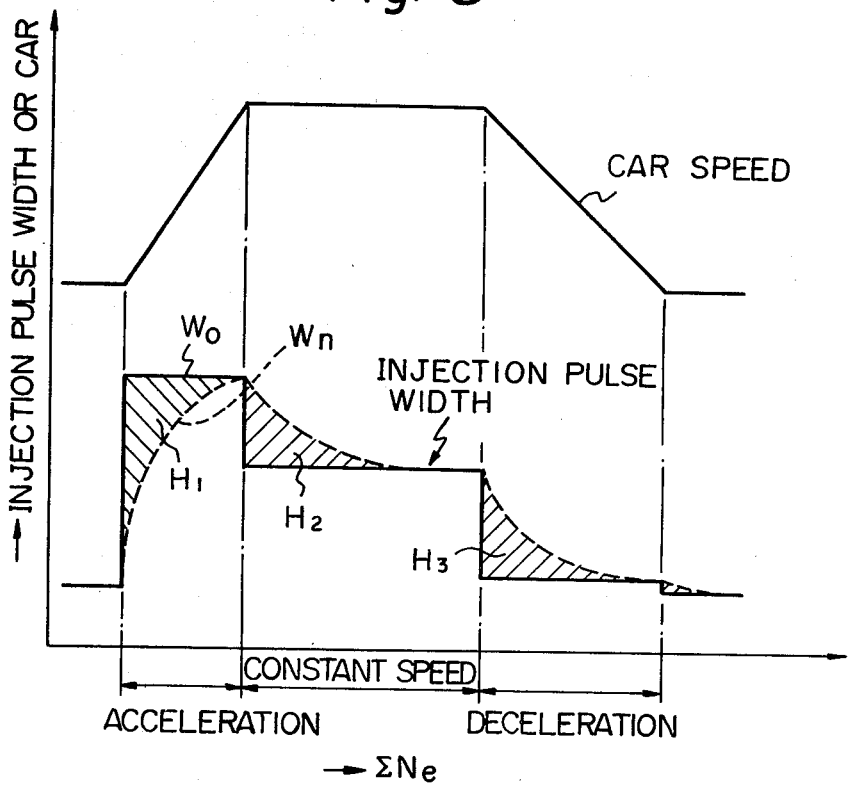
FIG. 8 illustrates the relationship between the accumulated number of rotations of the engine and the car speed and the width of the fuel injection pulse.

FIG. 8 illustrates the relationship between the accumulated number $\Sigma N_e$ of rotations of the engine and the car speed and the width ($W_o$, $W_n$) of the fuel injection pulse. $W_n$ represents the damped function which is obtained by damping the change of the value $W_o$ of the width of the pulse for the fuel injection by means of the filtering process. In each of the regions of $\Sigma N_e$, the change of the value $W_n$ converges to the corresponding value $W_o$. The hatched portion $H_1$ represents the value to be corrected for the increase of the fuel injection during a period of acceleration where the supply of fuel is deficient. The hatched portion $H_2$ represents the value to be corrected for the decrease of the fuel injection during a period of constant speed where the supply of fuel is excessive. The hatched portion $H_3$ represents the value to be corrected for the decrease of the fuel injection during a period of deceleration where the supply of fuel is excessive.

Figure 9:
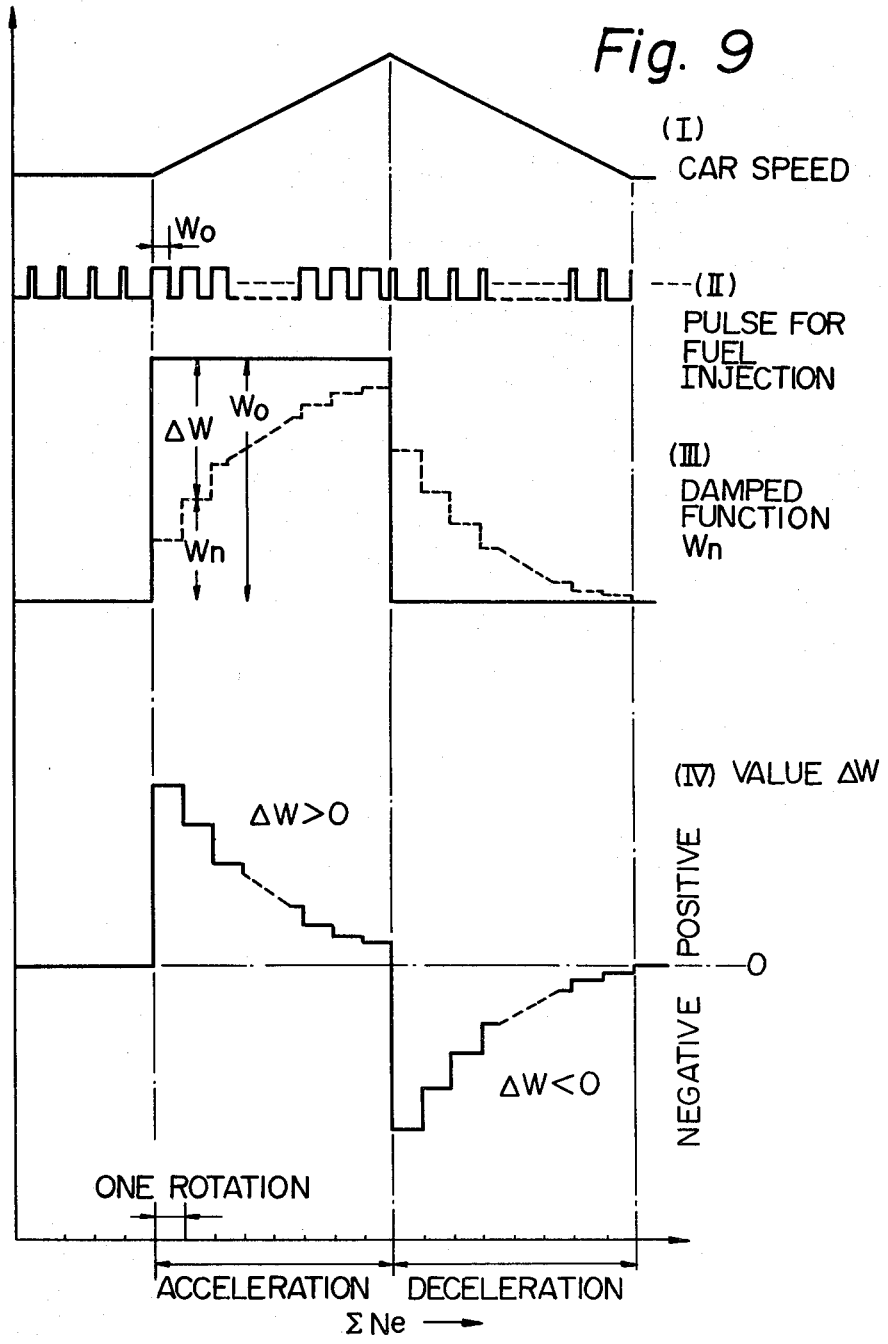
FIG. 9 illustrates the relationship between the accumulated number of rotations of the engine and the car speed and the values of pulse width for the fuel injection.

FIG. 9 illustrates the relationship between the accumulated number $\Sigma N_e$ of rotations of the engine and the car speed (I), the pulses (II) for the fuel injection having the width $W_o$ of the base fuel injection, the value $W_n$ (III) of the damped function obtained by damping the value $W_o$ through the digital filtering process and the value $\Delta W$ (IV) which corresponds to the presumed amount of fuel attached to the wall of the intake port.

The value $W_o$ is represented by the above mentioned equation (1). The value $W_n$ is represented by the above mentioned equation (2). The value $\Delta W$ is represented by the above mentioned equation (3).

Figure 10:
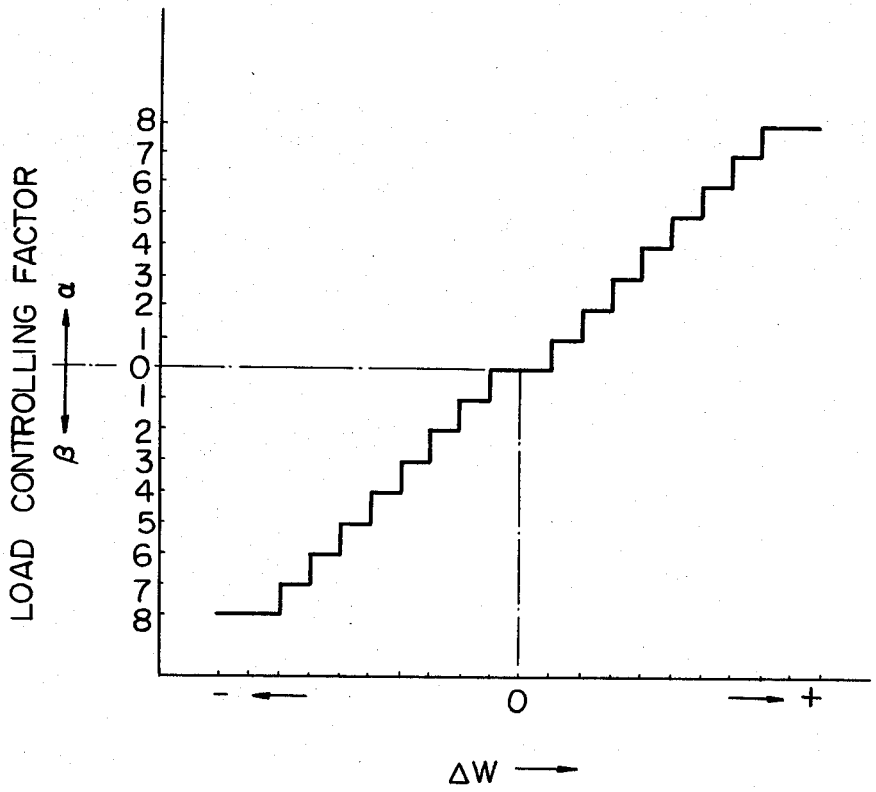
FIG. 10 illustrates the map defining the relationship between $\Delta W$ and the factors $\alpha$, $\beta$.

FIG. 10 is a map defining the relationship between $\Delta W$ and the load controlling factor ($\alpha$, $\beta$). "$\alpha$" is the load controlling factor for an increase of fuel, while "$\beta$" is the load controlling factor for a decrease of fuel.

Figure 11:
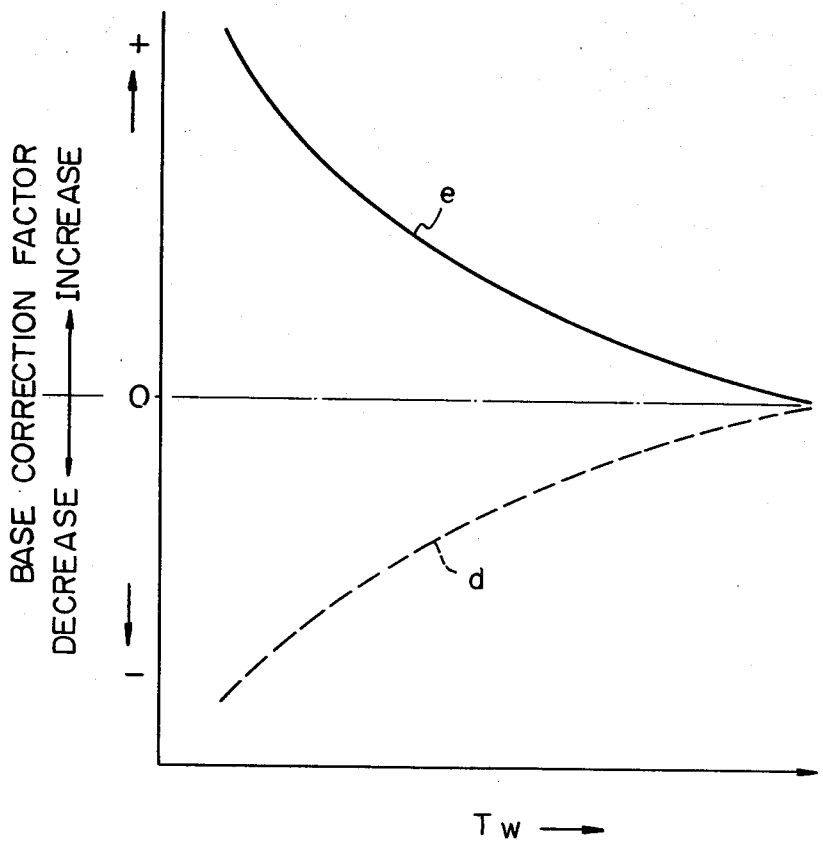
FIG. 11 illustrates the map defining the relationship between $T_w$ and the base correction factors d and e.

FIG. 11 is a map defining the relationship between the temperature $T_w$ (°C.) of the wall of the intake port and the base correction factor (d, e) of the amount of the fuel injection. "d" is the base correction factor (%) for a decrease of fuel, while "e" is the base correction factor (%) for an increase in the fuel injection.

The maps of FIGS. 10 and 11 are stored in the ROM 808 of the control circuit 8 of FIG. 5. As described with reference to the steps S108 and S110 in the flow chart of FIG. 6, the value D for correcting the decrease in the fuel injection and the value E for correcting the increase in the fuel injection are calculated in accordance with equations (4) and (5), respectively.

Figure 7:
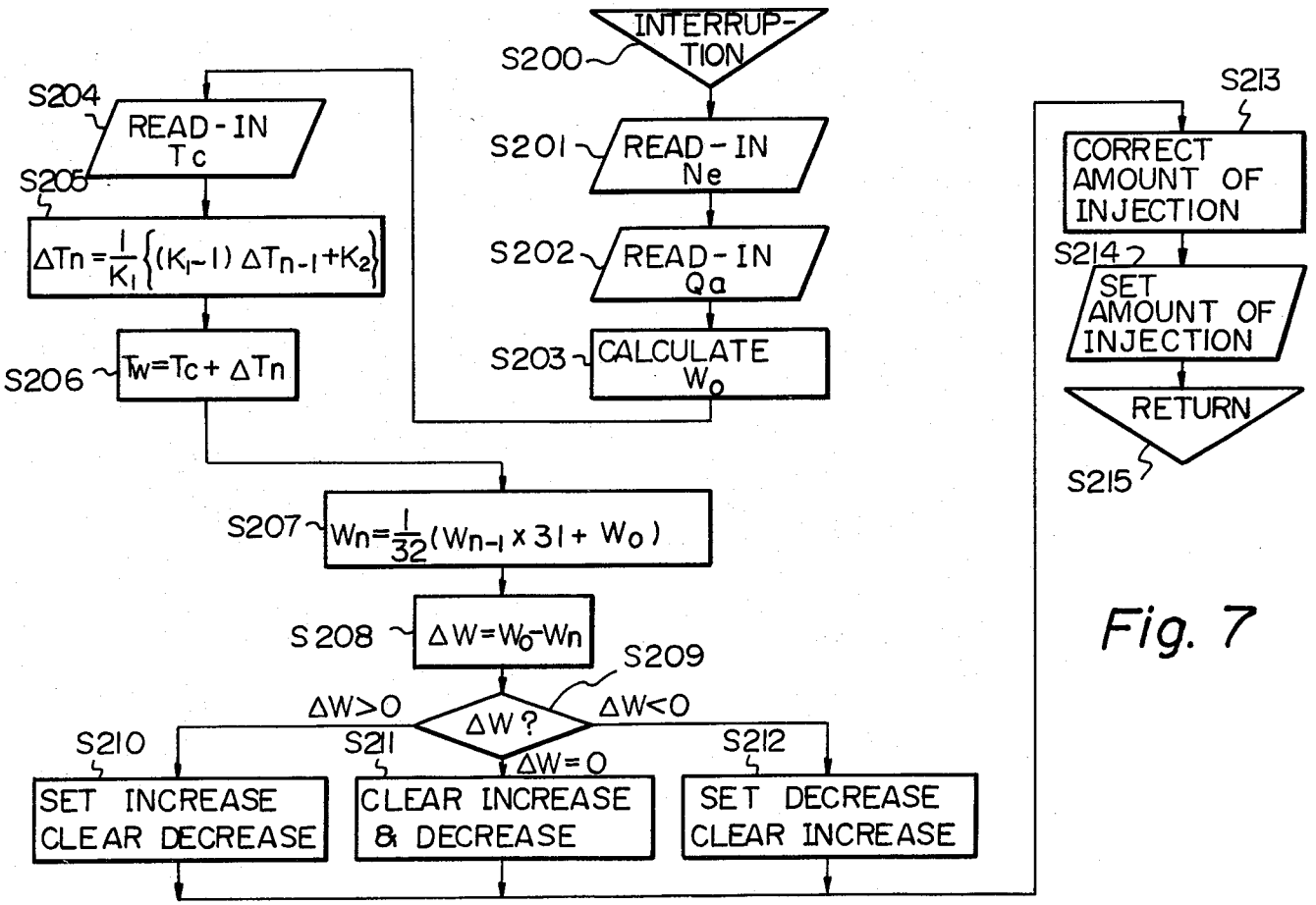
FIG. 7 illustrates a flow chart of another example of the operation of the central processor unit in the circuit of FIG. 5.

Another example of the operation of the CPU 800 in the control circuit 8 of FIG. 5 is illustrated in the flow chart of FIG. 7. The process from the step S201 through the step S203 is the same as that from step S101 to step S103 in FIG. 6. The temperature $T_c$ of the coolant is read-in from the analog input port 804 in the step S204.

The value $\Delta T_n$, which is the presumed value of the difference between the temperature $T_c$ of the coolant and the temperature $T_w$ of the wall of the intake port, is calculated by using the values $K_1$ and $K_2$ in step S205. The value $K_1$ is a constant determined by the temperature of the coolant at the start of the engine. The value $K_1$ is read out from the map of FIG. 13 which is stored in the ROM 808. The value $K_2$ is a constant inherent in the present engine. The calculation is expressed in equation (6) below.

$$\Delta T_n = 1/K_1\{(K_1 - 1)\Delta T_{n-1} + K_2\} \quad (6)$$

Equation (6) represents the process of damping the change of the difference between the temperatures $T_w$ and $T_c$. $\Delta T_n$ is the value of the damped function for the present rotational period of the engine, while $\Delta T_{n-1}$ is the value of the damped function for the preceding rotational period of the engine. $\Delta T_o$ is equal to zero.

The temperature $T_w$ of the wall of the intake port is calculated in step S206 in accordance with equation (7) below.

$$T_w = T_c + \Delta T_n \quad (7)$$

The obtained value $T_w$ is used in the following step as in the case of the flow chart of FIG. 6 where the temperature $T_w$ is obtained through measurement by the sensor 74. Accordingly the procedure from step S207 through step S214 are the same as that from step S105 through S112 in the flow chart of FIG. 6.

Figure 12:
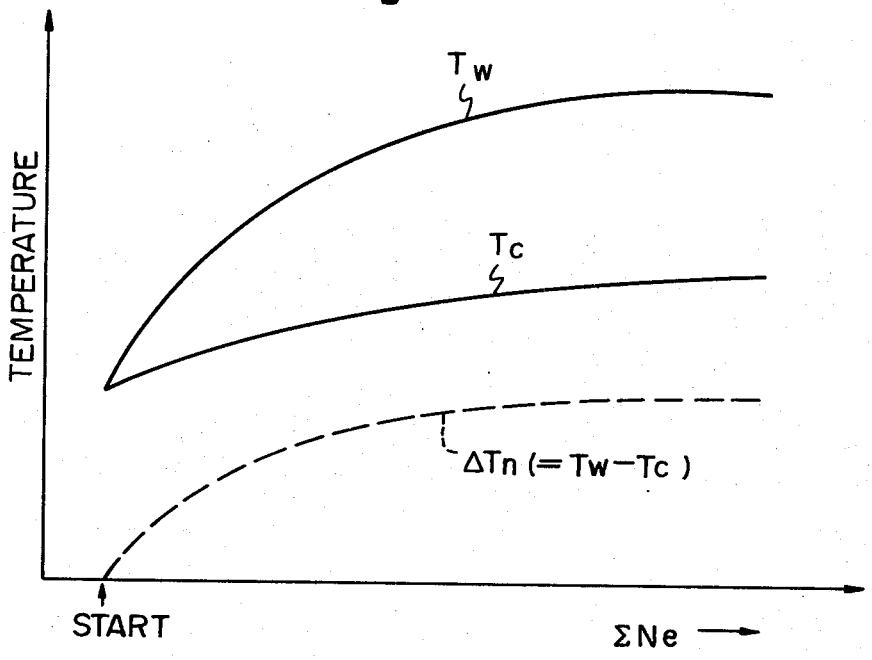
FIGS. 12 and 13 illustrate the basic characteristics of the operation of the apparatus in accordance with a modified embodiment of the present invention.
Figure 13:
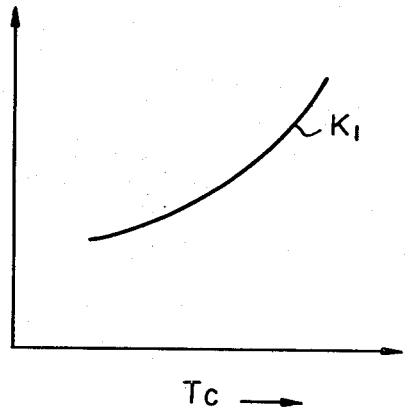

The basic characteristics of the operation expressed in the flow chart of FIG. 7 are illustrated in FIGS. 12 and 13. The changes of the temperature $T_c$ of the coolant and the temperature $T_w$ of the wall of the intake port and the changes of the difference between $T_c$ and $T_w$ with respect to the accumulated number $\Sigma N_e$ of the rotation of the engine are illustrated in FIG. 12. Since it is found that there exists a close correlation between the temperature difference $\Delta T_n(=T_w-T_c)$ and the accumulated number $\Sigma N_e$ of the rotation of the engine, the calculation of the presumed value of the temperature $T_w$ of the wall can be carried out in accordance with equation (6), above. Although the accumulated number $\Sigma N_e$ of rotation of the engine is assigned to the abscissa of FIG. 12, it is also possible to use the accumulated width $\Sigma W$ of the fuel injection pulse or the elapsed time "t" from the start of the engine for the value assigned to the abscissa. The relationship between the temperature $T_c$ of the coolant and the constant $K_1$ is illustrated in FIG. 13.

Although the specific embodiments of the present invention are described hereinbefore, it is also possible to provide variously modified embodiments of the present invention.

For example, although in the specific embodiment the degree of digital filtering in the formation of the damped function $W_n$ corresponding to the width $W_o$ of the fuel injection pulse is maintained to be constant, it is also possible in modified embodiments to vary the degree of digital filtering. The degree of digital filtering is expressed by the value L in equation (8) below.

$$W_n = 1/L\{(L-1)\cdot W_{n-1} + W_o\} \quad (8)$$

Figure 14:
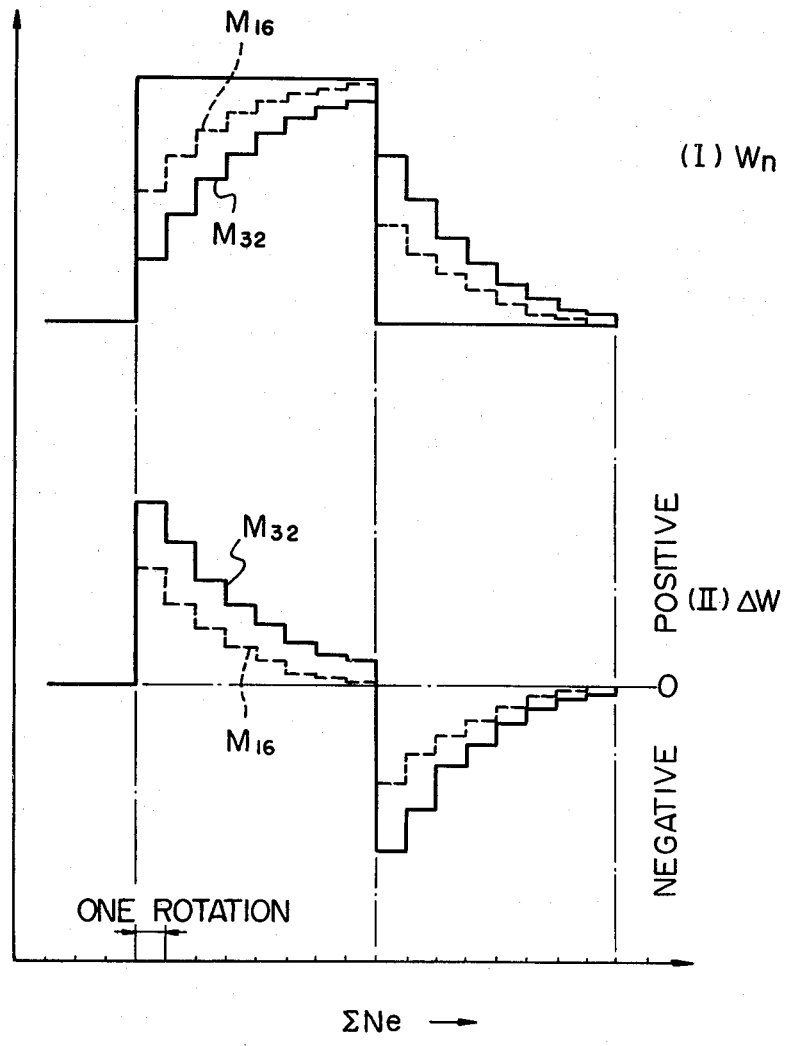
FIG. 14 illustrates the selection of the degree of the digital filtering in the filtering process.

In the modified embodiments, the value of L may be selected, for example, from 8, 16, 32 and 64. In the modified embodiments, the value of L may be varied in accordance with the operation condition of the engine, for example, temperature of the coolant, the rotational speed of the engine, degree of vacuum in the intake manifold, air flow rate, presence/absence of the air-fuel ratio feedback control, and the like. The change of the damped function $W_n$ in accordance with the selection of the value L is illustrated in FIG. 14. $W_n$ and $\Delta W$ in the case where $L=32$ is illustrated in line $M_{32}$, while $W_n$ and $\Delta W$ in the case where $L=16$ is illustrated in line $M_{16}$.

Also, the degree of digital filtering may be varied by adjusting the frequency of the calculation, for example, by changing from the calculation per each rotation of the engine to the calculation per every two rotations of the engine.

Although in the above described embodiments digital filtering is used in the formation of the damped function $W_n$, it is also possible to use analog filtering.

Although in the above described embodiments the corrections for both the acceleration and the deceleration are effected, it is also possible to effect the correction only for the acceleration or only for the deceleration.

In another modified embodiment of the present invention, it is possible to effect additionally the increase/decrease control of the amount of the fuel injection in accordance with the temperature of the coolant of the engine in the steady running state of the engine, not only in the acceleration or deceleration state of the engine.

In another modified embodiment of the present invention, it is possible to determine the state of the engine load from the changes in the pressure $P_i$ in the intake manifold, the rotational speed Ne of the engine, the rate $Q_a$ of the amount of the air intake, and the like, instead of the determination from the change in the width $W_o$ of the base fuel injection pulse corresponding to the rotational speed $N_e$ of the engine and the rate $Q_a$ of the amount of the air intake.

In another modified embodiment of the present invention, it is possible to determine the change in the engine load by detecting the difference between the preceding value and the present value, instead of the digital filtering method.

Also, in the analog method used in another embodiment of the present invention, it is possible to use a damping circuit using a capacitor for obtaining the difference between the damped value and the ordinary value and determining the value of the correction.

We claim:

1. An air-fuel ratio control method for an internal combustion engine having an intake port passage into which fuel is injected, comprising the steps of:

detecting the rotational speed of the engine to generate a first electrical signal which indicates the detected rotational speed $N_e$;

detecting the flow rate of air sucked into the engine to generate a second electrical signal which indicates the detected air flow rate $Q_a$;

detecting the warm-up condition of the engine to generate a third electrical signal which indicates the detected warm-up conditions $T_c$;

calculating a fuel-injection pulse-width $W_o$ in accordance with said first and second electrical signals;

calculating a wall-temperature $T_w$ of said intake port passage using said third electrical signal;

damping said fuel injection pulse-width $W_o$ in accordance with a predetermined filtering function to obtain a damped signal;

subtracting said damped signal from said fuel-injection pulse-width $W_o$ to generate a first correction value;

generating a second correction value from said wall temperature $T_w$; and determining a desired fuel injection amount from said fuel-injection pulse-width $W_o$, said first correction value and said second correction value.

2. A method as defined in claim 1, wherein said damping step includes the step of generating an average value $W_n$ using said fuel-injection pulse-width $W_o$, from the algebraic function $$W_n = -1/32(W_{n-1} \times 31 + W_o)$$

where $W_{n-1}$ is the last calculated average value.

3. A method for controlling the amount of fuel injected into an internal combustion engine in accordance with parameters of the operation of the engine, said fuel being injected toward the intake port of each of the cylinders of the engine, said method comprising the steps of:

generating a load signal related to the load on said engine at predetermined crank angle intervals of engine rotation;

generating a warm-up signal related to the temperature of said engine;

damping said load signal at predetermined crank angle intervals in accordance with a predetermined filtering function to obtain a damped value for estimating the change of amount of fuel deposited on a wall of the intake port of the engine;

generating a first correction value related to the difference between said damped value and said load signal;

estimating the temperature of the wall of the intake port of the engine from said warm-up signal and generating a second correction value corresponding to the estimated temperature; and determining the amount of fuel injection for the engine on the basis of said load signal, said first correction value, and said second correction value.

4. A method as defined in claim 1 wherein said warm-up signal generating step generates said warm-up signal using the temperature of the coolant of said engine and the total number of engine revolutions from the start of said engine.

5. A method as defined in claim 1 wherein said warm-up signal generating step generates said warm-up signal using the temperature of the coolant of said engine and the accumulated duration of fuel injection pulse signals from the start of said engine.

6. A method as defined in claim 1 wherein said warm-up signal generating step generates said warm-up signal using the temperature of the coolant of said engine and the length of time from the start of said engine.

7. A method as defined in claim 2, wherein said determining step includes a step of correcting said fuel-injection pulse-width $W_o$ using said first correction value, the polarity of said first correction value indicating whether said fuel-injection pulse-width $W_o$ is greater than or smaller than said average value $W_n$, said correcting increasing said fuel-injection pulse-width $W_o$ by said first correction value when said fuel injection pulse-width $W_o$ is greater than said average value $W_n$, and decreasing said fuel injection pulse-width $W_o$ by said first correction value when said fuel injection pulse-width $W_o$ is smaller than said average value $W_n$.

8. A method as defined in claim 1, wherein said wall-temperature is calculated, using the detected warm-up condition $T_c$, from the algebraic functions of $$\Delta T_n = 1/K_1\{(K_1-1)\Delta T_{n-1}+K_2\}$$

$$T_w = \Delta T_n + T_c$$

where $\Delta T_n$ is the presently calculated value, $\Delta T_{n-1}$ is the last calculated value, $K_1$ and $K_2$ are constants.

9. A method as defined in claim 3 wherein said warm-up signal generating step generates said warm-up signal using the temperature of said wall.

10. A method as defined in claim 3 wherein said warm-up signal generating step generates said warm-up signal using the temperature of the coolant of said engine and the total number of engine revolutions from the start of said engine.

11. A method as defined in claim 3 wherein said warm-up signal generating step generates said warm-up signal using the temperature of the coolant of said engine and the accumulated duration of fuel injection pulse signals from the start of said engine.

12. A method as defined in claim 3 wherein said warm-up signal generating step generates said warm-up signal using the temperature of the coolant of said engine and the length of time from the start of said engine.

13. A method as defined in claim 3 wherein said load signal generating step generates said load signal using the variations of the fuel injection pulse signals.

14. A method as defined in claim 3 wherein said load signal generating step generates said load signal using variations in the engine parameters.

15. A method as defined in claim 3 wherein said load signal generating step generates said load signal using the duration of fuel injection pulse signals.

16. A method as defined in claim 3 wherein the amount of filtering by said filtering function varies in accordance with engine parameters.

* * * * *

UNITED STATES PATENT AND TRADEMARK OFFICE

CERTIFICATE OF CORRECTION

PATENT NO. : 4,454,847

DATED : June 19, 1984

INVENTOR(S) : Shigenori ISOMURA et al

It is certified that error appears in the above-identified patent and that said Letters Patent is hereby corrected as shown below:

Column 3, line 65, read "ad" as --and--

Signed and Sealed this

*Twenty-sixth* Day of *March 1985*

[SEAL]

*Attest:*

DONALD J. QUIGG

*Attesting Officer* *Acting Commissioner of Patents and Trademarks*